US005417254A

United States Patent [19]

Kurmis

[11] Patent Number: 5,417,254

[45] Date of Patent: May 23, 1995

[54] BINDING TOOL

[75] Inventor: Viktor Kurmis, Pinneberg, Germany

[73] Assignee: Bowthorpe plc, Crawley, England

[21] Appl. No.: 145,966

[22] Filed: Oct. 29, 1993

[30] Foreign Application Priority Data

Nov. 2, 1992 [DE] Germany ..... 92 14 900.6 U

[51] Int. Cl.[6] ..... B21F 9/02

[52] U.S. Cl. ..... 140/93.2; 140/93 A; 140/123.6

[58] Field of Search ..... 140/93 A, 93.2, 123.5, 140/123.6

[56] References Cited

U.S. PATENT DOCUMENTS

| | | | |
|---|---|---|---|
| 3,515,178 | 6/1970 | Hidassy | 140/93.2 |
| 3,946,769 | 3/1976 | Caveney et al. | 140/93.2 |
| 3,976,108 | 8/1976 | Caveney et al. | 140/93 A |
| 4,178,973 | 12/1979 | Collier et al. | 140/123.6 |
| 5,050,649 | 9/1991 | Kurmis | 140/93 A |

FOREIGN PATENT DOCUMENTS 2401742 3/1979 France .

*Primary Examiner*—Lowell A. Larson
*Attorney, Agent, or Firm*—Chilton, Alix & Van Kirk

[57] ABSTRACT

Tool for binding an object by means of a strip, which has a strip tongue and a strip lock with a strip opening which receives the free end of the strip tongue. The tool comprises a lock holder and a loop guide, which originates from the lock holder, returns thereto and can be opened and closed, for guiding the strip around the object to be bound. Furthermore, the tool comprises a slide for feeding the strip into a position in which the strip tongue is located in the loop guide, and the lock is located in the lock holder. According to the invention, the lock holder is at least partially formed by the slide. In consequence, other holding parts having associated drive and control means are superfluous for fixed enclosure of the lock in the holder. The part of the lock holder which is arranged on the slide may have a guide for the free strip end which enters into the lock holder region from the loop guide. In consequence, it is possible to arrange the lock holder directly on the circular circumference which is available for retaining the object to be bound.

6 Claims, 3 Drawing Sheets

Figure 1:
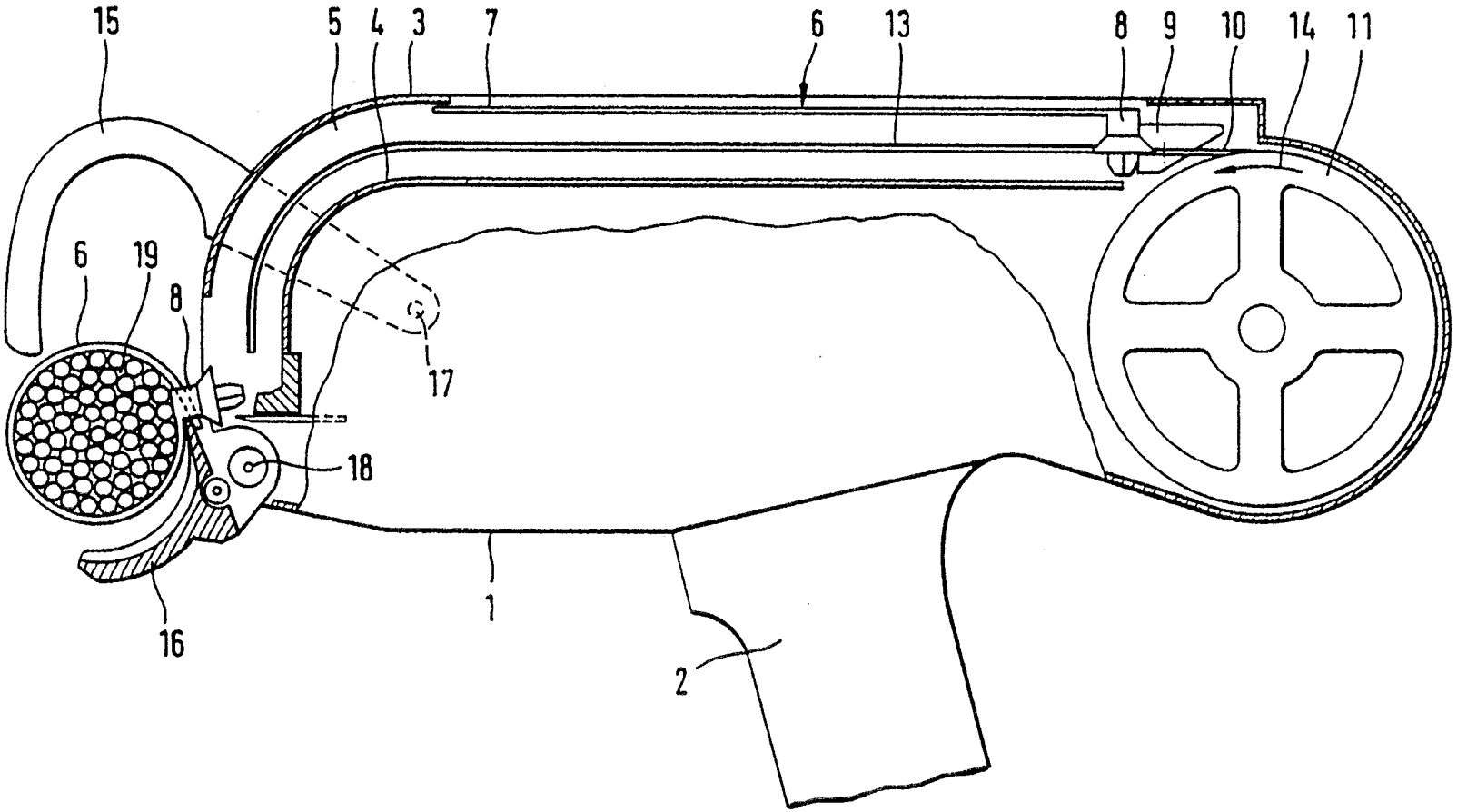

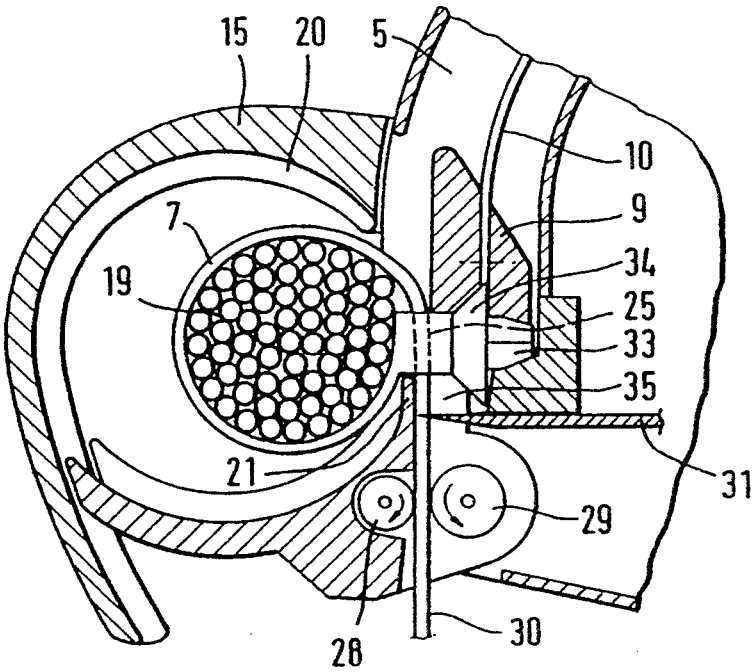
Fig. 4
Fig. 5
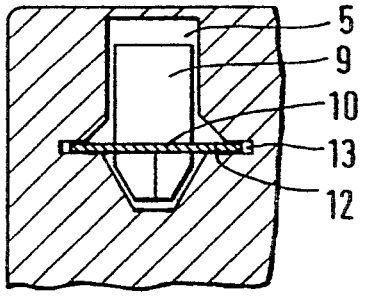

BINDING TOOL

The invention relates to a tool for binding an object, for example a cable harness, by means of a strip, which has a strip tongue and a strip lock with a strip opening which receives and holds the free end of the strip tongue. The tool comprises a lock holder for retaining the strip lock during the binding process and a loop guide, which originates from the lock holder, returns thereto and can be opened and closed, for guiding the strip around the object to be bound. The tool furthermore comprises a slide for feeding the strip into a position in which the strip tongue is located in the loop guide, and the lock is located in the lock holder.

When the tip of the strip tongue is pushed into the strip opening of the lock, the strip lock must occupy a precisely predefined position. It is known for moving holding parts to be provided for this purpose, which enclose the lock in the provided position (U.S. Pat. No. 3,891,012). Suitable movement and control devices must be provided for these holding parts.

The invention achieves a simplification of this arrangement in that the lock holder is formed at least partially by the slide.

The slide moves into its final position without special control and drive means being required for this purpose. For this purpose, the head of the slide is provided with a shape which is matched in a suitable manner to its function as part of the lock holder. In addition, the slide, or the head of the slide forming the holding part, is guided in a guide which fixes its position with respect to the lock holder.

The position of the slide head in the lock holder is thus determined on the one hand by the guide whose guide surfaces run parallel to the slide moving direction, and on the other hand by a force which holds the slide head in the holding position. In this case, it may simply be the feed force which has previously fed the slide into the holding position. However, separate devices may also be provided for this purpose.

If the slide head is held in the holding position by the feed force, its position along its guide is determined by the resistance of the strip lock. On the side opposite the slide, the strip lock is therefore supported by a stop which participates there in forming the lock holder. Said stop expediently comprises a spur which is located such that its tip lies between the original connection of the strip tongue to the lock and the strip tongue and the strip opening. This design has the advantage that the spur takes over the task of guiding the tip of the strip tongue into the loop guide during insertion of the strip.

If the end of the tongue which is passed through the strip opening of the lock is not cut off directly behind the lock, but projects a little beyond it, the spur is located after the end of the clamping process between the origin and the projecting end of the strip and can therefore prevent release of the lock from the holder if the releasing movement runs at right angles to the strip direction. In one advantageous embodiment of the invention, it is therefore provided that the spur, and/or other parts of the holder which engage in front of a projection of the lock or in front of the strip, can be pivoted away after the binding process, to be precise expediently in the latter direction in which the lock is intended to be removed from the holder.

According to one special feature of the invention, the spur and these other parts of the holder, which engage in front of a projection of the lock or in front of the strip which protrudes from the lock, are rigidly connected to a part of the loop guide which can pivot, the pivoting point being arranged such that the spur and these parts are moved during opening of the loop guide somewhat in the direction in which the lock is to be removed from the lock holder. In consequence, not only are the spur and these parts removed from the position in which they would impede removal of the lock from the tool, but they also complete a type of ejection movement, by means of which the lock is removed with the strip and the bound object from the binding position and can therefore more easily be taken out.

According to the invention, the spur may also be a part of a cutting device which is intended for cutting the projecting strip end, or may carry such an element.

The free end of the strip tongue requires a guide in order to reach the correct position for insertion into the strip opening of the lock. According to the invention, at least a part of this guide may be formed on the slide. This has the advantage that the end of the loop guide may be at a relatively large distance from the lock holder, which allows the guide to be brought forward very close to the circumference of the free space, which is provided inside the loop guide for retaining the object to be bound, for feeding the strip into the binding position and for guiding the slide into the holding position. In particular, the circumferential contour may also have an approximately circular shape. This is in advantageous contrast to known devices (EP-A 0,264,142) in which the lock holder is arranged at the tip of an angled interstice which emerges from the region around which the loop is to be placed, which has the disadvantage that the object which is to be bound, for example a cable harness, is prevented from assuming the ideal circular cross-sectional shape under the tension of the strip; this can lead to inadequate strip tension or results in complications in the design of the tool. As a result of the arrangement of the guide on the slide, in addition, so much space is created between the end of the loop guide and the lock holder that even those locks which are particularly voluminous can be extracted therefrom, because they are equipped with, for example, projecting attachment devices.

Figure 2:
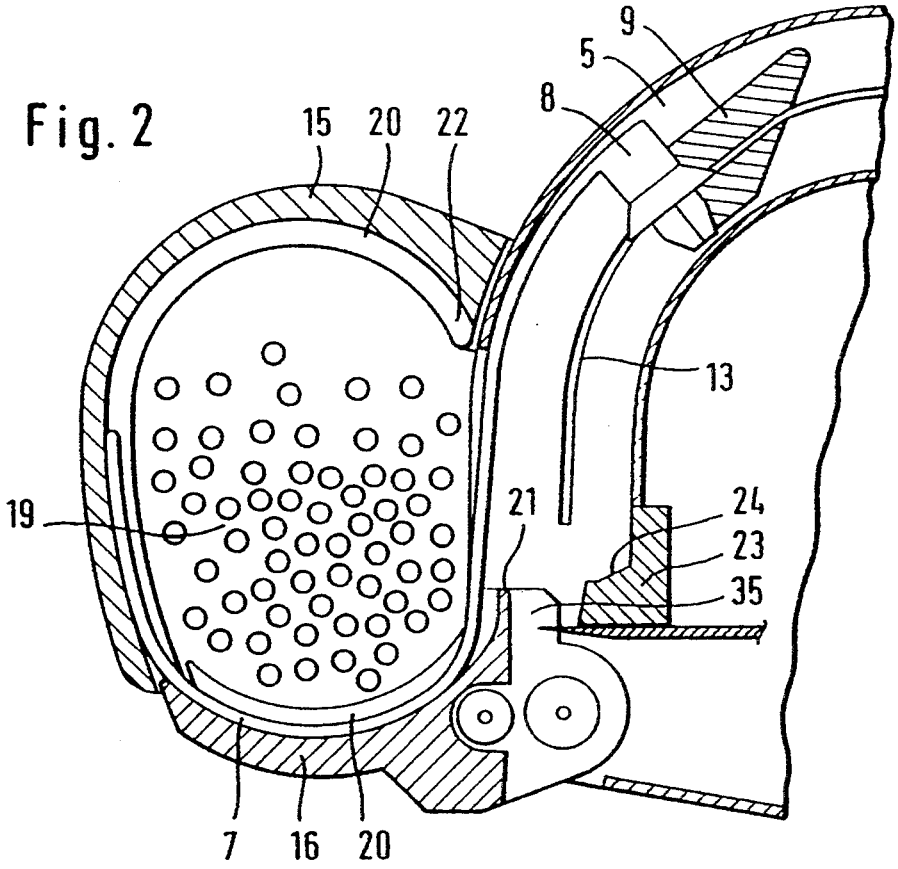
Figure 3:
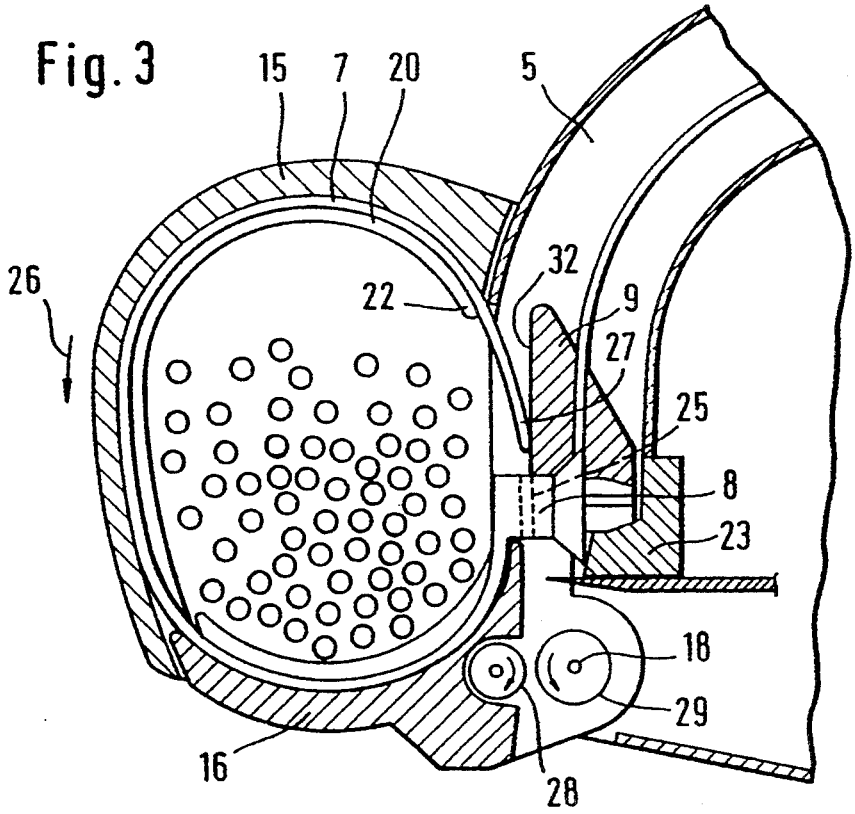

The invention is explained in more detail in the following text, making reference to the drawing which shows an advantageous exemplary embodiment schematically, and in which:

FIG. 1 shows a schematic longitudinal section through the tool,

FIGS. 2–4 show longitudinal sections through the front tool region, on a larger scale, and different phases of operation, and FIG. 5 shows a cross-section through the slide guide According to FIG. 1, the tool has a tool body 1 and a handle 2 by which said tool can be held. A guide channel 5 for a strip 6 consisting of viscoelastic synthetic material, such as polyamide, is located between the walls 3 and 4 of the housing body 1. Said strip 6 passes in any desired manner into the position inside the channel 5 which is shown in FIG. 1, for example using automatic means, which are not shown, from a strip magazine, or by hand. The strip has a strip tongue 7 and a head 8, the tip of the strip tongue pointing towards the front end of the tool body, which is shown on the left in FIG. 1, while the head 8 is located at the rear. Located behind the lock 8 in the guide channel 5 is a slide head 9 whose end, which interacts with the lock 8, is matched to the shape of the lock 8, and which is attached to the front end of a flexible steel strip 10 which is wound on a roll 11. The head 9 and the steel strip 10 together form a slide for pushing the strip 6 out of the position shown in FIG. 1 into that position (FIG. 3) in which the strip is used for binding an object.

The edges 12 of the steel strip 10 project on the sides beyond the slide head 9 (FIG. 5) and are retained by grooves 13 in the side walls of the guide channel 5 such that they can slide. Furthermore, the profile of the guide channel 5 may (but does not need to) be matched to the profile of the strip lock 8 in order to hold the latter at right angles to the feed direction on its way into the binding position.

If the roll 11 is rotated in the arrow direction 14, the steel strip 10 is pushed forwards with the slide head 9 along the guide channel 5. In order that the steel strip 10 does not stick during this between the roll 11 and the housing wall surrounding the roll, it may have a pretensioning to hold it on the circumference of the roll 11. The slide which is formed by the strip 10 and the slide head 9 is drawn back into the original position shown in FIG. 1 by means of a movement counter to the arrow direction 14. Drive and control means, which are of a conventional type and therefore require no description, are provided for driving and controlling the rotation of the roll 11.

At the front end, the tool has pliers which are formed by the parts 15 and 16. Said pliers form a guide for the strip 6 during its movement looping around the object which is to be bound. The part 15 of the pliers can pivot about the axis 17; the part 16 of the pliers can pivot about the axis 18. Drive and control means are provided which ensure that the parts of the pliers can pivot out of the open position shown in FIG. 1 into further functional positions, as is described in more detail below. These drive and control means are of a conventional type and are therefore not shown or explained.

In the opened position (FIG. 1), the pliers hold an object which is to be bound, which may be, for example, a harness of cables 19 (FIG. 2) which is intended to be firmly bound together by means of the strip 6, as is shown in the final phase in FIG. 1. In this phase, the strip tongue 7 surrounds the cable harness 19 under tension. The free end of the strip tongue 7 is guided through the lock 8 and is fixed therein. The projecting end of the strip tongue is cut off.

In order that the strip tongue can be looped around the object 19 which is to be bound, the parts 15 and 16 of the pliers are moved into a closed looping-round position, according to FIG. 2. They contain a guide groove 20 whose width corresponds approximately to that of the strip tongue 7 and whose depth is considerably greater than the thickness of the strip tongue 7. The guide groove 20 is bounded at its start by a spur 21 which is firmly connected to the part 16 of the pliers. When the tip of the strip tongue 7 is inserted into the start of the guide groove 21, which is carried out using means which are not of interest here its further movement is determined by this groove around the object 19 which is to be bound and which ends at 22 on the inner end of the part 15 of the pliers.

When this final position is reached, the lock 8 has likewise reached its final position, which is determined by the lock holder. Said lock holder consists of a holding part 23 which is fixed to the housing and whose surface facing the lock 24 is at least partially matched to the shape of the lock. Furthermore, the already-mentioned spur 21 and the region 35 behind the spur 21, which is cut out in the plane of the drawing for the strip to pass through but on the sides thereof (above and below the plane of the drawing) can form stop surfaces for the lock, belong to the lock holder. In the position shown in FIGS. 2 to 4 of the part 16 of the pliers, the spur 21 and the part 35 together with the holding part 23 which is fixed to the housing form a stop which is matched to the shape of the lock 8 such that its position in the holder can be determined unambiguously, provided the lock 8 is pressed against these holding parts. This takes place by means of the slide head 9, which is constructed as a third holding part. As a result of a feed force, which is exerted continuously on the steel strip 10 and can be determined, for example, by means of a sliding clutch or spring in the drive of the roll 11, the slide head 9 presses the lock 8 against the holding parts 21, 23 and in consequence precisely determines the final position of the lock. At the same time, the spur 21 catches between the strip tongue 7, where the latter is integrally connected to the lock 8, and the aperture of the strip opening 25, which is indicated by dashed lines, for receiving the strip tongue in the lock. This means that, during the looping-round movement (FIG. 2), the tip of the strip must pass through on the front side, but behind the spur in the final state. The spur itself rests between these two strip regions as a stop on the lock body, and thus participates in the positioning of the latter. This resting of the spur on the lock body is not absolutely necessary. It is necessary only that the holding parts 21, 23, 9 interact with the surface of the lock body in such a manner that its position is fixed unambiguously.

The lock is shaped such that the strip takes its origin approximately in the feed direction from the lock and such that the strip opening 25 is approximately parallel to this direction. Precise parallelism is not necessary. The strip opening could rather be rotated, when considering FIG. 3, for example, even a little in the anti-clockwise direction with respect to the direction shown.

When the lock 8 has reached its final position in the lock holder, the free end of the strip tongue is located approximately at the end 22 of the loop guide or between this end and the strip lock 8. The strip tip is preferably close to the lock 8. The strip tip must now be inserted into the strip opening 25 of the lock. This is done (FIG. 3) by the part 15 of the pliers being pivoted further out of the loop position shown in FIG. 2, in the arrow direction 26. In consequence, the extent which is available for retaining the strip tongue 7 is shortened. Since the lock 8 is fixed during this, the strip tip 27 in FIG. 3 must therefore be moved further downwards. When the part 15 of the pliers has reached its final position shown in FIG. 4, the free end of the strip tongue 7 is passed through the strip opening 25, and has reached the gap between two clamping rollers 28, 29, which rotate in the arrow direction during this and grip and clamp the strip end.

According to FIG. 4, the clamping process is continued until the desired tension in the strip tongue 7 is achieved and the object which is to be bound (cable 19) is firmly encircled.

The projecting strip end 30 must now be cut off. Provided for this purpose is a blade 31 which is guided in its longitudinal direction and is connected to conventional drive and control means, which are not shown. In order to make the cut, it is moved to the left in FIG. 4, so that its blade cuts through the strip tongue. At the same time, it uses the spur 21 as an opposing bearing. It may be adequate for this, if the spur forms a smooth bearing surface for the strip in its opposing-bearing region, as shown. However, instead of this, an impression can be provided at this point into the surface of the spur, which depression forms an opposing blade or cutting edge which interacts with the blade.

As can be seen in FIG. 3, the distance between the end 22 of the loop guide and the lock 8 is relatively large. This is a result of the circumstance that the lock holder is arranged directly on the circular circumference of the binding cross-section. In consequence, the feed movement of the strip from the guide channel 5, on the one hand, and the movement of the strip from the loop guide 20, on the other hand, intersect at an acute angle in the distance region between the end 22 of the loop guide and the lock holder. This large distance can be avoided if the two paths are guided at right angles with respect to one another (EP-A 0,264,142), but other, more severe disadvantages must then be accepted.

The guiding uncertainty in the distance between the end 22 of the loop guide 20 and the lock holder is overcome by the invention in that the invention provides the slide head 9 with a guide surface for the strip tip. As can be seen in FIG. 2, the slide head 9 has a surface 32 which faces the open side of the tool, opens close to the strip opening 25 of the lock 8, and on which the tip 27 of the strip can slide along in order to find the opening. The guide surface 32 may be of groove-shaped design in order also to provide side guidance for the strip tip 27; however, in general, this is not necessary.

Once the binding process has been completed in accordance with FIG. 4, the slide 9, 10 can be drawn back into its original position (FIG. 1), and the bound object can be extracted. During the extraction, those parts 21, 23 of the lock holder which are opposite the slide head 9 may be a hindrance if they are firmly arranged and engage in front of any shaped projections of the lock 8. For example, if the head 8 which is shown in the drawing has an attachment part 33 which grips a plate 34 which projects on all sides. This plate is located behind the spur 21 and partially behind the holding region 35. However, since these parts 21, 35 are firmly connected to the lower part 16 of the pliers, they are pivoted forwards, and also a little downwards, during the opening movement of the part of the pliers, into the open position shown in FIG. 1. This is achieved by the pivoting point 18 of the part 16 of the pliers being arranged under and behind these parts. These parts therefore move on an arc which is pointed downwards and to the left in the drawing. In consequence, a movement in the extraction direction, like an ejector, acts on the object. The opening also increases in size in consequence, through which the projecting parts of the lock can be extracted, so that the extraction is simplified.

Thereafter, the process can start once again.

I claim:

1. Tool for binding an object by means of a strip (6), which has a strip tongue (7) and a strip lock (8) with a strip opening (25) which receives the free end of the strip tongue (7), the tool comprising a lock holder (21, 35, 23, 9) and a loop guide (20), which originates from the lock holder, returns thereto and can be opened and closed, for guiding the strip tongue (7) around the object (19) to be bound, as well a slide (9, 10) for feeding the strip into a position (3) in which the lock (8) is located in the lock holder (21, 23, 35, 9) and the strip tongue (7) is located in the loop guide (20), the tip (27) of the strip tongue (7) being located ready for insertion in front of the strip opening (25), and the lock (8) is located in the lock holder (21, 23, 35, 9), characterized in that the lock holder is formed at least partially by the slide (9) and by lock supporting means (21, 35) which can be at least partially removed after the binding process and in that the tool includes a guide channel for guiding the strip toward the lock holder, the guide channel tangentially intersecting the loop guide adjacent the lock holder.

2. Tool according to claim 1, characterized in that, the lock supporting means comprises a spur (21) which is located between the original connection of the lock (8) to the strip tongue (7), on the one hand, and the strip opening (25), on the other hand.

3. Tool according to claim 2, characterised in that the spur (21) can be pivoted away after the binding process.

4. Tool according to claim 3, characterised in that the spur (21) is rigidly connected to a part (16) of the loop guide (22) which can pivot, the pivoting point being arranged such that the spur (21) is moved during opening of the loop guide somewhat in the direction in which the lock (8) is to be removed from the lock holder.

5. Tool according to claim 2, characterized in that the tool includes a cutting element (31) and the spur (21) forms an opposing bearing for the cutting element (31).

6. Tool according to claim 2, characterised in that the spur (21) forms the start of the loop guide (20).

* * * * *